US007149443B2

(12) United States Patent
Konishi

(10) Patent No.: US 7,149,443 B2
(45) Date of Patent: Dec. 12, 2006

(54) IMAGE FORMING APPARATUS WITH IMAGE TRANSFER BELT STABILIZATION

(75) Inventor: Hidehisa Konishi, Chuo-Ku (JP)

(73) Assignee: Kyocera Mita Corporation, Osaka (JP)

( * ) Notice: Subject to any disclaimer, the term of this patent is extended or adjusted under 35 U.S.C. 154(b) by 88 days.

(21) Appl. No.: 10/821,176

(22) Filed: Apr. 9, 2004

(65) Prior Publication Data

US 2004/0264988 A1 Dec. 30, 2004

(30) Foreign Application Priority Data

Apr. 11, 2003 (JP) ..... 2003-107468

(51) Int. Cl.
*G03G 15/00* (2006.01)

(52) U.S. Cl. ..... 399/49

(58) Field of Classification Search ..... 399/49, 399/60, 72, 73, 74
See application file for complete search history.

(56) References Cited

U.S. PATENT DOCUMENTS 5,768,671 A * 6/1998 Komiya et al. ..... 399/301

FOREIGN PATENT DOCUMENTS

| | | | |
|---|---|---|---|
| JP | 11015218 A | * | 1/1999 |
| JP | 11065397 A | * | 3/1999 |
| JP | 11220586 A | * | 8/1999 |
| JP | 2000321838 A | | 11/2000 |
| JP | 2003076111 A | * | 3/2003 |

* cited by examiner

*Primary Examiner*—Arthur T. Grimley
*Assistant Examiner*—Ryan Gleitz
(74) *Attorney, Agent, or Firm*—Crowell & Moring LLP.

(57) ABSTRACT

The positioning of an image read sensor for accurately reading the toner image on the belt member becomes easy. The image read sensor 21 is located on the supporting frame 26 provided to the casing of the image forming apparatus so that it faces the belt member such as an intermediate transfer belt 45 between the driving roller 46 and follower roller 48 when the belt unit is mounted to the casing of the apparatus. The supporting frame 26 is provided with shaft supporting recesses 27. The shaft member is supported for rotation in the belt unit such that it contacts the inside surface of the belt member and pushes the belt member outward at the position it faces the image read sensor across the belt member when the belt unit is mounted to the casing of the apparatus.

5 Claims, 5 Drawing Sheets

PRIOR ART

PRIOR ART (a)

PRIOR ART (b)

PRIOR ART

IMAGE FORMING APPARATUS WITH IMAGE TRANSFER BELT STABILIZATION

BACKGROUND OF THE INVENTION

1. Field of the Invention

The present invention is related to an image forming apparatus such as a copying machine, printer, or facsimile machine using electrophotographic process, specifically to an image forming apparatus having a belt member onto which images are to be formed.

2. Description of the Related Art

Generally, an image forming apparatus is known in which a toner image formed on a belt member is directly or indirectly transferred to a copy sheet.

One of such image forming apparatuses is, for example, a tandem type color image forming apparatus in which a plurality of image forming devices are located along an intermediate transfer belt as the belt member looped over a plurality of rollers. In the image forming apparatus, image forming devices of, for example, black (B), yellow (Y), magenta (M), and cyan (C) are arranged one after another along the intermediate transfer belt in the direction of travel of the belt. Each of the image forming devices is provided with an electric charger, a photoreceptor drum which is an image carrier member, an exposure unit, a developing device, and a cleaning unit, etc. The latent image formed on the photoreceptor drum is developed to a toner image by the developing device and the toner image on the drum is transferred as a primary transferred image to the intermediate transfer belt.

In this way, the toner images of B, Y, M, and C are sequentially transferred to the intermediate transfer belt, and color images are formed on the intermediate transfer belt. The color toner images are transferred to a copy sheet at the secondary image transferring position as a secondary transferred image, then the color image on the copy sheet is permanently fixed to the copy sheet by a fusing unit to be released.

Said intermediate transfer belt is generally unitized as an intermediate image transfer unit as shown in FIG. 4. In FIG. 4, the intermediate image transfer unit has a unit frame 11 to which are attached a driving roller 46, a follower roller 48, and a tension roller 47, the rollers being an example of said plurality of rollers. An intermediate transfer belt 45 is looped over these rollers. The intermediate transfer belt 45 is driven by the driving roller 46 to travel in the direction of an arrow as shown in FIG. 4. A black, yellow, magenta, and cyan image forming devices, for example though not shown in FIG. 4, are arranged between the tension roller 47 and the driving roller 46 one by one above the belt 45 in order from upstream to downstream of the traveling direction of the belt 45, and the transfer of the images on the intermediate transfer belt 45 to a copy sheet (secondary image transfer) is done at the position of the follower roller 46.

In the color image forming apparatus, a concentration sensor for detecting the concentration of the toner image transferred to the intermediate transfer belt 45 (primary transferred image) and a registration sensor for adjusting the timing of the primary transferred image on the intermediate transfer belt to reach the position of second image transferring and the timing of transferring the copy sheet to the position of secondary image transferring, are provided (hereafter, said concentration sensor and registration sensor are together referred to as an image read sensor).

Errors in image formation due to the conditions of the environment in which the image forming apparatus is used and variations in the constituent parts of the image forming apparatus, are eliminated by virtue of the image read sensor.

An optical sensor, for example, is used for the image read sensor. Generally, when using an optical sensor it is necessary to accurately adjust the distance between the sensor and the object to be measured. If the distance from the sensor to the object deviates from the right distance, the sensitivity of the sensor decreases and accurate detection is not possible.

As described above, the intermediate transfer belt 45 is looped over the driving roller 46, follower roller 48, and tension roller 47, the belt being tensioned by means of the tension roller 47 so that it does not slack. On the other hand, the follower roller 48 is located nearer to the tension roller 47 in order to configure the intermediate transfer unit in low profile to realize a compact unit. As a result, the distance between the driving roller 46 and the follower roller 48 (i.e. the position of secondary image transferring) becomes long.

As shown in FIG. 5, an image read sensor 21 is attached to a support member 21*a* to face toward the intermediate transfer belt 45 at the position between driving roller 46 and follower roller 48 to detect the toner images transferred to the intermediate transfer belt 45.

The intermediate image belt 45 is generally made of rubber material, and the distance between the driving roller 46 and follower roller 48 is very long compared with that between the follower roller 48 and tension roller 47. As a result, there is the case the intermediate transfer belt 45 slacks as shown in FIG. 6 by dashed double dotted line. When the slack of the belt like this occurs, the image on the belt falls out of focus of the image read sensor and the accuracy of detection of image is deteriorated.

The intermediate image transfer unit is mounted detachably on the image forming apparatus to be replaced as needed. When replacing the intermediate image transfer unit, it is necessary to position the intermediate image transfer unit to keep the distance between the intermediate transfer belt 45 and the image read sensor 21 as it was before the replacement. For this, the image read sensor 21 is attached to the bottom face of a frame member 22 fixed to the casing not shown of the image forming apparatus, the frame member 22 having supporting recesses 22*a* formed on both side walls thereof for supporting the rotation shaft 46*a* of the driving roller 46 as shown in FIGS. 7(*a*) and (*b*). When the intermediate image transfer unit 30 is replaced, the rotation shaft 46*a* of the new unit is located on the supporting recesses 22*a*.

However, even if the positioning of the intermediate image transfer unit 30 is performed as shown in FIG. 7(*a*), (*b*) to keep the distance between the belt 45 and the image read sensor 21, if the belt 45 slacks, the surface of the belt 45 can not be brought in focus of the image read sensor 21, resulting in deteriorated accuracy of image reading.

There is disclosed an image forming apparatus, in which the image read sensor is located at the position remotest from the second image transferring position, where the intermediate transfer belt is traveling in the direction perpendicular to the direction of the movement of the secondary image transfer roller for engaging/disengaging with/from the belt and where the toner image transferred onto the belt can be read (see Japanese Laid-Open Patent Application No. 2000-321838, column 0062~0067, FIG. 1).

It is possible by the method of said disclosure to deal with the vibration of the intermediate transfer belt induced by the engaging/disengaging of the secondary image transfer roller with/from the belt at the second image transferring position, for when the image read sensor is located at the position remotest from the second transferring position and capable of reading the toner image transferred onto the intermediate transfer belt traveling in the direction perpendicular to the direction of engaging/disengaging movement of the secondary image transfer roller with/from the belt, the influence that the vibration in the direction perpendicular to the image plane exerts upon the accuracy of reading image is the smallest. However, the slack of the intermediate transfer belt itself is not taken into consideration, and when the image read sensor faces the belt at the driving roller, there remains a problem that the influence of the driving motion of the driving roller can not be evaded.

Further, in said disclosure no consideration is given as to how the positioning of the intermediate image transfer unit and the image read sensor is done, and moreover there is a problem that it is difficult to locate the image read sensor near the driving roller, for space is limited near the driving roller.

Any way, there are problems that it is not possible to accurately read or detect the image due to the slack of the intermediate transfer belt and that accurate relative positioning of intermediate transfer belt and the image read sensor is difficult.

SUMMARY OF THE INVENTION

An object of the present invention is to provide an image forming apparatus capable of reading with high accuracy the image on a belt member such as an intermediate transfer belt. Another object of the invention is to provide an image forming apparatus in which the positioning of an image read sensor is easy.

The present invention proposes an image forming apparatus comprising in the casing of the apparatus; a belt member which is a photosensitive belt or an intermediate transfer belt or a transfer material carrying belt, a driving roller for driving said belt member, a follower roller, a tension roller for tensioning said belt member, the tension roller being located at the position remoter than the position of said follower roller from said driving roller, the distance between said driving roller and said follower roller being longer than that between said follower roller and said tension roller; an image detecting means located at a position facing the belt member between said driving roller and follower roller for detecting the toner image on said belt member; and a contact member contacting the inside surface of the belt member at the position facing said image detecting means across the belt member to push the belt member toward said image detecting means.

By locating an image detecting means (image read sensor) for detecting the toner image on the belt member facing the belt member between the driving roller and follower roller and allowing the contact member to push the belt member toward the image detecting means in the state the contact member contacts the belt member while facing the image detecting means across the belt member, the belt member does not slack or the distance between the image detecting means and belt member at the position of the shaft member does not change even if slack or vibration occurs in the belt member, the distance between the image detecting means and belt member can always be kept constant. Therefore, the accuracy of detection of image is not deteriorated.

For example, the belt member, driving roller, follower roller, and tension roller are integrated as a belt unit, said contact member being attached to the belt unit.

By composing so that the contact member is attached to the belt unit integrating the belt member, driving roller, follower roller, and tension roller, the distance between the image detecting means and the surface of the belt member can be kept always constant.

In the present invention, the contact member is a shaft member which is supported for rotation in the belt unit such that the outer perimeter thereof contacts the inside surface of the belt member. Further, the casing of the apparatus is provided with a supporting frame with said image detecting means attached thereto, and the supporting frame has at least two supporting recesses for supporting said shaft member, and said image detecting means is fixed to said supporting frame so that the image detecting means faces the line connecting the centers of said supporting recesses. The belt unit is detachable to said casing of the apparatus, and said shaft member comes to be supported in the supporting recesses when said belt unit is mounted to the casing of the apparatus.

By using as the contact means the shaft member which is supported for rotation in the belt unit such that its outer perimeter contacts the inside surface of the belt member, and by fixing the image detecting means to the supporting frame which is attached to the casing of the apparatus having at least two supporting recesses at the position the image detecting means faces the line connecting the centers of the supporting recesses, it becomes easy to position the shaft member so that the shaft member faces the image detecting means and the distance between the image to be detected on the belt member and the image detecting means is kept always constant. As a result, the accuracy of detection of image is always kept high.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
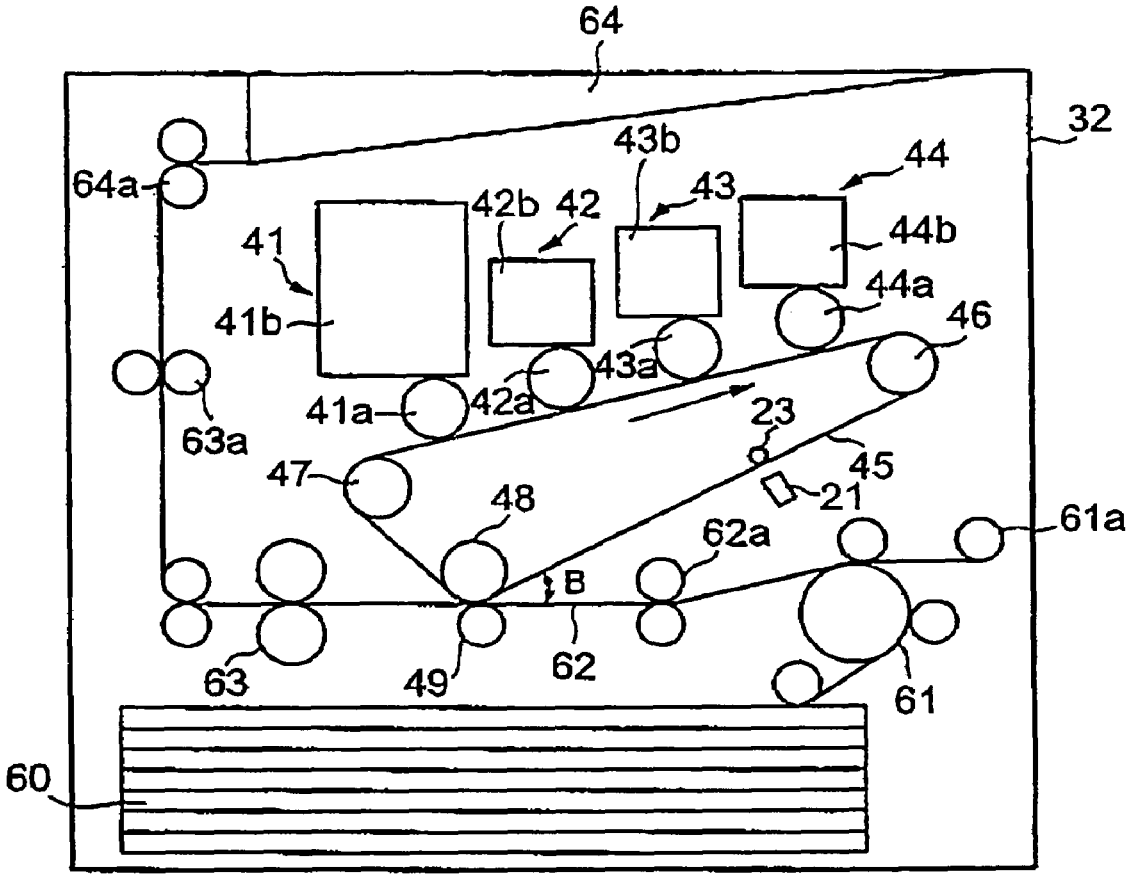
FIG. 1 is a schematic illustration of an example of the configuration of the image forming apparatus according to the present invention.

Referring to FIG. 1, the image forming apparatus is provided with a plurality of image forming units 41~44, each of the units being provided with a photoreceptor drum (latent image carrier member) 41*a*~44*a* and a toner container 41*b*~41*b*.

In the example of FIG. 1, each of the image forming unit 41, 42, 43, and 44 corresponds respectively to black (B), yellow (Y), magenta (M), and cyan (C). The photoreceptor drums 41*a*~44*a* of the image forming unit 41~44 are arranged in sequence in the direction of traveling of the intermediate transfer belt 45, the photoreceptor drum 41*a* being located in the extremity of upstream side and the photoreceptor drum 44*a* being located in the extremity of downstream side.

Figure 4:
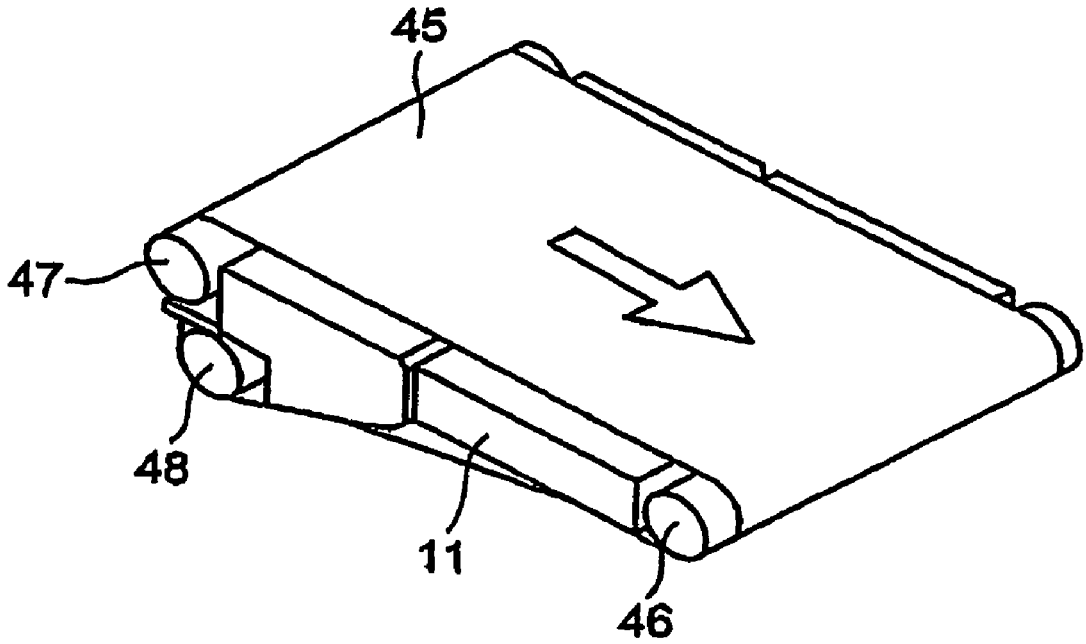
FIG. 4 is a perspective view showing schematically an example of an intermediate transfer unit.
Figure 5:
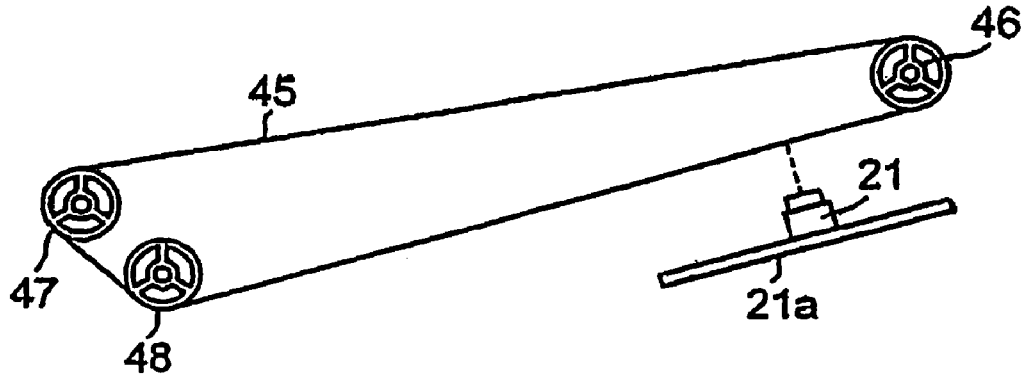
FIG. 5 is a side view showing positioning of the image read sensor relative to the intermediate transfer belt of a conventional image forming apparatus.
Figure 6:
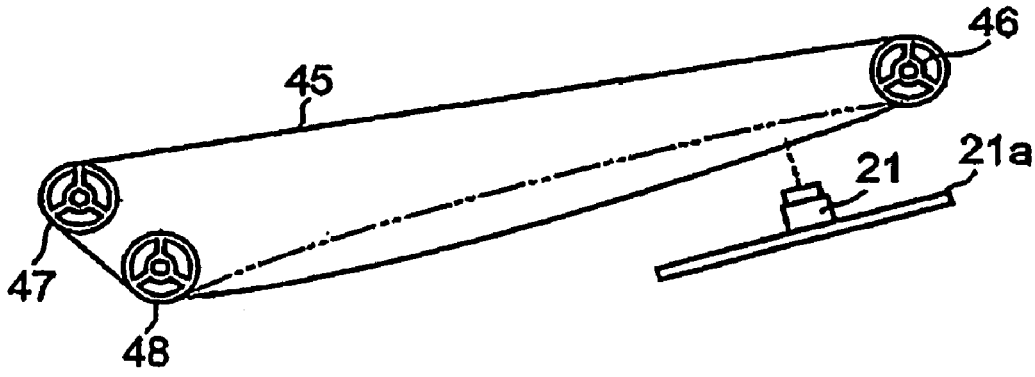
PRIOR ART Fig. 6
FIG. 6 is an illustration showing when the intermediate transfer belt shown in FIG. 5 slacks.
Figure 7:
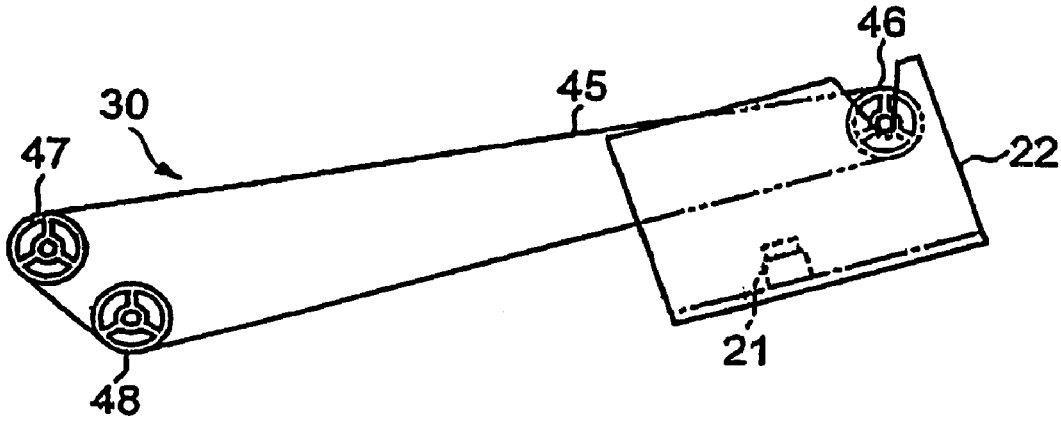
FIG. 7 is an illustration for explaining the supporting frame which supports the rotation shaft of the driving roller and to which the image read sensor is attached in the conventional image forming apparatus, (a) is a side view, and (b) is a perspective view.
Figure 7:
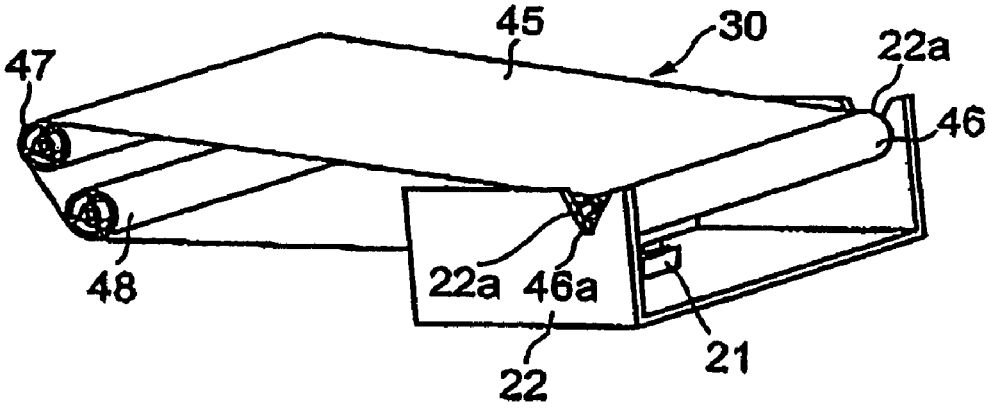

The intermediate transfer belt 45 is supported by the driving roller 46, tension roller 47, and follower roller 48, these rollers being supported by a frame 11 to compose the intermediate transfer unit (see FIG. 4). The intermediate transfer unit is mounted detachably to the casing 32 of image forming apparatus. The intermediate transfer belt 45 is driven by the driving roller 46 to travel in the direction indicated by the arrow in the drawing, the belt 45 being properly tensioned by means of the tension roller as mentioned later.

When the intermediate transfer unit is mounted to the casing 32 of the image forming apparatus, the follower roller 48 is positioned to face the secondary image transfer roller 49. The primary image transferring section is defined between the driving roller 46 and tension roller 47, and said image forming units 41, 42, 43, and 44 are arranged along the primary image transferring section.

The intermediate transfer belt 45 is inclined upward from the left to the right in the drawing in the primary image transferring section, that is, the intermediate transfer belt 45 is inclined upward from the photoreceptor drum 41*a* toward the photoreceptor drum 44*a*. The follower roller 48 is located near the position vertically below the photoreceptor drum 41*a*. As a result, the follower roller 48 is located near the tension roller 47.

When forming a toner image on a recording medium (copy sheet) toner images are formed on the photoreceptor drums 41*a*~44*a* in synchronization with the traveling of the intermediate transfer belt 45. The toner images on the photoreceptor drum are transferred sequentially onto the intermediate transfer belt 45 to form the primary transferred toner images. The copy sheet (not shown in the drawing) is fed from a sheet feeder 60, first reversed by the sheet reversing roller 61 and then transported on the copy sheet transfer path 62 passing through a pair of registration rollers 62*a*, to the secondary image transferring position. The copy sheet is nipped together with the intermediate transfer belt 45 between the follower roller 48 and secondary image transfer roller 49, and the primary transferred toner images are transferred to the copy sheet by means of the secondary image transfer roller 49. The secondary image transfer roller 49 is secured in position unlike the case with conventional image forming apparatuses. When the secondary image transfer to the copy sheet is not performed, a transfer bias voltage of the polarity opposite to that applied when image formation is carried out is applied to the secondary image transfer roller 49 to prevent the contamination of the secondary image transfer roller 49 by toner.

Then the copy sheet is transported to a fusing unit 63 consisting of a pair of rotors. After fusing, the sheet is transferred through a pair of transfer rollers 63*a* and a pair of ejecting rollers 64*a* to be released to a catch tray 64. The copy sheet may be fed manually onto the copy sheet transfer path 62 by utilizing a roller 61*a* for manual feeding.

Figure 2:
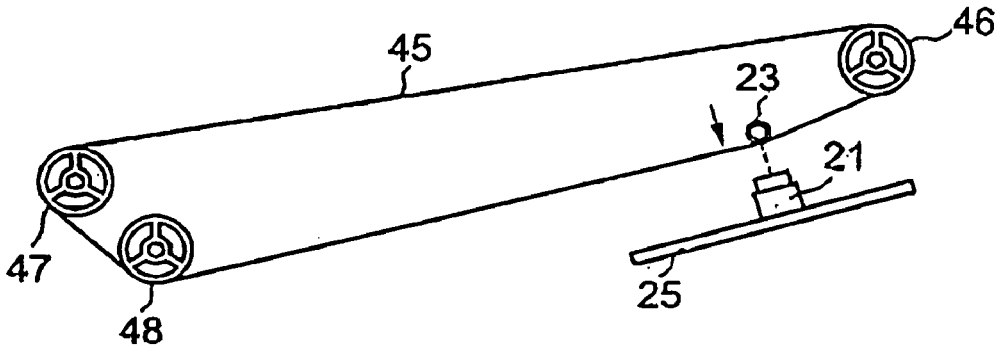
FIG. 2 is a side view showing the positioning of the image read sensor and shaft member in the image forming apparatus of FIG. 1, the intermediate transfer belt as a belt member being sandwiched between them.

Referring also to FIG. 2, between the driving roller 46 and follower roller 48 is located the image read sensor 21 facing the intermediate transfer belt 45. The image read sensor 21 is fixed to a supporting frame 25 which is a constituent member of the casing not shown in FIG. 2 of the image forming apparatus. The toner image on the intermediate transfer belt 45 is read by the image read sensor 21, for example, to control the drive timing of the registration rollers and to adjust the concentration of the image.

A shaft member 23 of circular cross section is located at the position facing the image read sensor 21 across the intermediate transfer belt 45, outer perimeter of the shaft member 23 being in contact with the inside surface of the intermediate transfer belt 45 and pushing the intermediate transfer belt 45 toward the image read sensor 21 as shown in FIG. 2 by an arrow.

The shaft member 23 is supported for rotation by the frame not shown in the drawing of the intermediate transfer belt unit at the position the image read sensor 21 faces the shaft member 23 across the intermediate transfer belt 45 when the intermediate image transfer unit is mounted on the casing of the image forming apparatus. The outer perimeter of the shaft member 23 is coated with fluorine or molybdenum, etc.

Since the intermediate transfer belt 45 is pushed by the shaft member 23 toward the image read sensor 21 between the driving roller 46 and follower roller 48, and the image read sensor 21 is located to face the shaft member 23 across the intermediate transfer belt 45, that means that the image read sensor 21 reads the image on the intermediate transfer belt 45 at the position the shaft member 23 is located where the possibility of slacking of the belt 45 is less. Therefore, even if slack or vibration occurs in the belt 45, the distance between the image read sensor 21 and intermediate transfer belt 45 can be always kept to coincide with the focal length of the image read sensor 21. Therefore, the accuracy of detection of image is not deteriorated.

Figure 3:
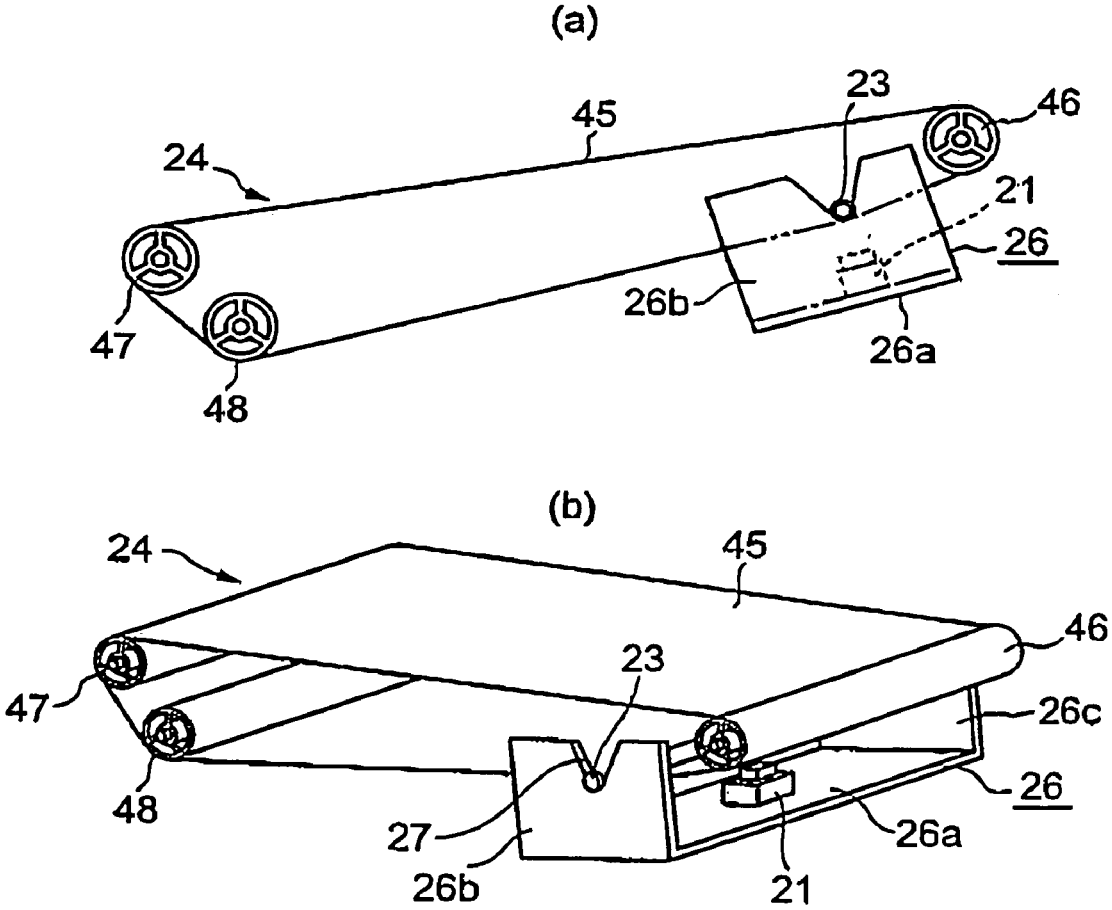
FIG. 3 is an illustration for explaining the supporting frame which supports the shaft member and to which the image read sensor is attached in the image forming apparatus of FIG. 1, (a) is a side view, and (b) is a perspective view.

Referring to FIGS. 3(*a*) and (*b*), in this example the image read sensor 21 is fixed to the supporting frame 26. The supporting frame 26 has a bottom plate 26*a* and a flange part 26*b* and 26*c*, both the flame parts extending upward in both edge parts of the bottom plate 26*a* in the direction perpendicular to the bottom plate 26*a*. The distance between the flange parts 26*b* and 26*c* is wider than the width of the intermediate transfer belt 45. The supporting frame 26 is a constituent member of the casing of the image forming apparatus.

Supporting recesses 27, which face to each other, and of which only one can be seen in FIGS. 3(*a*) and (*b*), are formed on the top of the flange part 26*b* and 26*c*, and the shaft member 23 is supported on the supporting recesses 27. The image read sensor 21 is fixed to the upper face of the bottom plate 26*a* such that the image read sensor 21 is positioned such that its center is on the plane which is perpendicular to the bottom plate 26*a* and contains the line connecting the center of the supporting recesses 27.

As mentioned before, the intermediate image transfer unit 24 is detachably mounted to the casing of the image forming apparatus. When replacing the intermediate image transfer unit 24, the unit is mounted to the casing of the image forming apparatus such that both end parts of the shaft member 23 are placed on the supporting recesses 27.

By mounting the intermediate image transfer unit 24 like this, the shaft member 23 is located naturally on the line connecting the center of the supporting recesses 27. As the image read sensor 21 is fixed right below the line, the relative positioning of the shaft member 23 to the image read sensor 21 can be easily performed, and as a result the accuracy of detection of image does not change by replacing the intermediate image transfer unit 24.

Although in the embodiment, the explanation was done about the image forming apparatus in which an intermediate transfer belt is used as a belt member, it is needless to say that the present invention can be applied to other belt members such as transfer material carrying belt or photosensitive belt.

As has been described in the foregoing, according to the present invention, an image detecting means (image read sensor) for detecting the toner image on a belt member is located facing the belt member between the driving roller and follower roller, and a contact member (shaft member) is provided so that it contacts the inside surface of the belt member to push the belt member toward the image detecting means, so the belt member does hardly slack. Even if slack or vibration occurs, the distance between the image detecting means and the contact member does not change, so that the distance between the image detecting means and the belt member can be kept always constant. Therefore, the accuracy of detection of image is not deteriorated.

In the present invention, the belt member, driving roller, follower roller, and tension roller are integrated as a belt unit and the contact member is attached to said unit, so that the distance between the image detecting means and the belt member can be kept always constant.

In the present invention, a shaft member is used as contact means, the shaft member is supported for rotation in the belt unit such that its outer perimeter contacts the inside surface of the belt member of the belt unit between the driving roller and follower roller, the image detecting means is attached to the supporting frame which is a constituent part of the casing of the image forming apparatus and has at least two supporting recesses for supporting said shaft member when the belt unit is mounted to the image forming apparatus, the image detecting means being fixed to the supporting frame such that it faces the line connecting the centers of the supporting recesses, so that it is easy to position the shaft member to face the image detecting means properly to keep always constant the distance between the image detecting means and the belt member. As a result, the accuracy of detection of image is always kept high.

What is claimed:

1. An image forming apparatus comprising in the casing of the apparatus;

a belt member which is a photosensitive belt or an intermediate transfer belt or a transfer material carrying belt, a driving roller for driving said belt member, a follower roller, a tension roller for tensioning said belt member, the tension roller being located at the position remoter than the position of said follower roller from said driving roller, the distance between said driving roller and said follower roller being longer than that between said follower roller and said tension roller, and the belt being approximately linear in shape between said driving roller and follower roller;

an image detecting means located at a position below and facing the belt member between said driving roller and follower roller for detecting the toner image on said belt member; and a contact member contacting an upper, inside surface of the belt member at the position facing said image detecting means across the belt member to push the belt member toward said image detecting means.

2. The image forming apparatus according to claim 1, wherein said belt member, driving roller, follower roller, and tension roller are integrated as a belt unit; and said contact member is attached to the belt unit.

3. The image forming apparatus according to claim 2, wherein said contact member is a shaft member which is supported for rotation in the belt unit such that the outer perimeter thereof contacts the inside surface of the belt member.

4. The image forming apparatus according to claim 3, wherein the casing of the apparatus is provided with a supporting frame with said image detecting means attached thereto, the supporting frame has at least two supporting recesses for supporting said shaft member, and said image detecting means is fixed to said supporting frame such that the image detecting means faces the line connecting the centers of said supporting recesses.

5. The image forming apparatus according to claim 4, wherein said belt unit is detachable to said casing of the apparatus, and said shaft member comes to be supported in the supporting recesses when said belt unit is mounted to the casing of the apparatus.

* * * * *